US005889224A

United States Patent [19]

Tanaka

[11] Patent Number: 5,889,224

[45] Date of Patent: Mar. 30, 1999

[54] KARAOKE SCORING APPARATUS ANALYZING SINGING VOICE RELATIVE TO MELODY DATA

[75] Inventor: Takahiro Tanaka, Hamamatsu, Japan

[73] Assignee: Yamaha Corporation, Hamamatsu, Japan

[21] Appl. No.: 900,199

[22] Filed: Jul. 25, 1997

[30] Foreign Application Priority Data

Aug. 6, 1996 [JP] Japan ..... 8-223068

[51] Int. Cl.[6] ..... G10H 7/00

[52] U.S. Cl. ..... 84/645; 434/307 A; 84/616

[58] Field of Search ..... 84/616, 609, 634, 84/645, 654; 434/307 A; 704/270

[56] References Cited

U.S. PATENT DOCUMENTS 5,434,949 7/1995 Jeong ..... 84/477 R X
5,477,003 12/1995 Muraki et al. ..... 434/307 A
5,525,062 6/1996 Ogawa et al. ..... 434/307 A
5,693,903 12/1997 Heidorn et al. ..... 84/668
5,715,179 2/1998 Park ..... 84/610 X
5,719,344 2/1998 Pawate ..... 84/609

*Primary Examiner*—Stanley J. Witkowski
*Assistant Examiner*—Jeffrey W. Donels
*Attorney, Agent, or Firm*—Pillsbury Madison & Sutro LLP

[57] ABSTRACT

A scoring apparatus is constructed for evaluating a live vocal performance which is voiced by a singer along with a karaoke music synthetically reproduced from melody data. A first detector sequentially detects the live vocal performance to extract therefrom sample data which is characteristic of actual voicing of the singer. A second detector sequentially detects the melody data to extract therefrom time data representative of right progression of the karaoke music and reference data representative of right voicing which should match the karaoke music. A comparator sequentially compares the sample data and the reference data with each other to produce differential data which indicates difference between the actual voicing and the right voicing. A processor processes the differential data with reference to the time data to produce score data which represents degree of deviation of the live vocal performance voiced by the singer relative to the karaoke music.

10 Claims, 6 Drawing Sheets

KARAOKE SCORING APPARATUS ANALYZING SINGING VOICE RELATIVE TO MELODY DATA

BACKGROUND OF THE INVENTION

1. Field of the Invention

The present invention generally relates to a karaoke scoring apparatus for evaluating singing skill of a karaoke singer based on actual singing voice vocalized by the singer along with instrumental accompaniment of karaoke music. More particularly, the present invention relates to a karaoke scoring apparatus for detecting score data necessary for scoring the singing skill of the karaoke singer by comparing the actual singing voice of the singer with a melody of the karaoke music. The actual singing voice is vocalized along with the accompaniment of the karaoke music generated by a MIDI tone generator.

2. Description of Related Art

The conventional karaoke apparatus utilizes a musical sound player which reproduces karaoke music from a magnetic tape on which the karaoke music is recorded in the form of an analog audio signal. With the advance in electronics technology, the magnetic tape is replaced by a CD (Compact Disk) or an LD (Laser Disk). The audio signal recorded in a disk media is changed from analog to digital. The data recorded on these disks contains not only music data but also a variety of other items of data including image data and lyrics data.

Recently, communication-type karaoke apparatuses become popular, in which, instead of using the CD or the LD, music data and other karaoke data are delivered through a communication line such as a regular telephone line or an ISDN line. The delivered data is processed by a tone generator and a sequencer. These communication-type karaoke apparatuses include a non-storage type in which music data is delivered every time karaoke play is requested, and a storage-type in which the delivered music data is stored in an internal storage device such as a hard disk unit and read out from the internal storage device for karaoke play upon request. Currently, the storage-type karaoke apparatus is dominating the karaoke market mainly because of its lower running cost.

Some of the above-mentioned karaoke apparatuses have a karaoke scoring device designed to evaluate singing skill of a karaoke singer based on voice of the singer vocalized along with the accompaniment of karaoke music. The conventional karaoke scoring device detects pitch and level of the singing voice of the karaoke singer, and checks the detected pitch and level with respect to stability and continuity of live vocal performance for evaluation and scoring.

However, the evaluation and scoring by the conventional karaoke scoring device are made independently of tempo information and melody information contained in the karaoke music data. There is no correlation between the actual vocal performance and the accompanying karaoke music. In the conventional scoring device, the evaluation is made without any relationship with melody information and tempo information contained in the karaoke music data. Namely, the conventional scoring device simply evaluates only the way of singing of the karaoke singer regardless of regulated progression of the karaoke music. Therefore, the conventional karaoke scoring device cannot draw distinction between good singing performance well synchronized with karaoke accompaniment and poor singing made out of tune. The conventional scoring device can evaluate only physical voicing skill of a karaoke singer, and consequently cannot evaluate the singing skill in musical relationship with the melody information contained in the karaoke music data.

SUMMARY OF THE INVENTION

It is therefore an object of the present invention to provide a karaoke scoring apparatus capable of detecting score data for evaluating singing skill of a karaoke singer relative to music information concerning an original melody provided by a MIDI (Musical Instrument Digital Interface) message.

According to the invention, a scoring apparatus is constructed for evaluating a live vocal performance which is voiced by a singer along with a karaoke music synthetically reproduced from melody data. The scoring apparatus comprises a first detector that sequentially detects the live vocal performance to extract therefrom sample data which is characteristic of actual voicing of the singer, a second detector that sequentially detects the melody data to extract therefrom time data representative of model progression of the karaoke music and reference data representative of model voicing which should match the karaoke music, a comparator that sequentially compares the sample data and the reference data with each other to produce differential data which indicates difference between the actual voicing and the model voicing, and a processor that processes the differential data with reference to the time data to produce score data which represents degree of deviation of the live vocal performance voiced by the singer relative to the karaoke music.

In a preferred form, the first detector sequentially detects the live vocal performance to extract therefrom volume sample data which indicates volume variation of the actual voicing of the singer, and the second detector sequentially detects the melody data to extract therefrom volume reference data which represents volume variation of the model voicing which should match the karaoke music. In another preferred form, the first detector sequentially detects the live vocal performance to extract therefrom pitch sample data which indicates pitch variation of the actual voicing of the singer, and the second detector sequentially detects the melody data to extract therefrom pitch reference data which represents pitch variation of the model voicing which should match the karaoke music. In a further preferred form, the first detector sequentially detects the live vocal performance to extract therefrom volume sample data and pitch sample data, which respectively indicate volume variation and pitch variation of the actual voicing of the singer, and the second detector sequentially detects the melody data to extract therefrom volume reference data and pitch reference data, respectively representing volume variation and pitch variation of the model voicing which should match the karaoke music.

Practically, the second detector sequentially detects the melody data containing a sequence of notes to extract therefrom note-on time data and note-off time data of each note to represent the model progression of the karaoke music, and the processor processes the differential data with reference to the note-on time data and the note-off time data to produce the score data. Specifically, the second detector sequentially decodes the melody data provided in the form of MIDI message to extract therefrom the time data representative of the model progression of the karaoke music and the reference data representative of the model voicing which should match the karaoke music, and the processor processes the differential data with reference to the time data to produce the score data encoded in the form of MIDI message which represents degree of deviation of the live vocal performance voiced by the singer relative to the karaoke music. As used hereinafter, the terms "model voicing" and "model progression" denote the voicing and progression as intended and created by the karaoke music synthetically reproduced from an original melody data, so as to enable the karaoke scoring apparatus to detect score data for evaluating a live vocal performance voiced by a karaoke singer relative to music information concerning the original melody data. Further, the second detector sequentially detects the MIDI message to extract therefrom the time data in terms of sequential occurrence of notes representing the model progression of the karaoke music, and the reference data in terms of volume and pitch of the notes representing the model voicing which should match the karaoke music.

In the present invention, based on the actual voice of the karaoke singer, the pitch sample data and volume sample data of the voice are detected. On the other hand, detected from a karaoke MIDI message are the note-on and note-off data corresponding to the song melody to be vocalized by the singer, and the pitch reference data and volume reference data in the MIDI message. Then, the pitch sample data detected based on the voice of the singer is compared with the pitch reference data in the MIDI message by a pitch comparator, and the volume sample data based on the voice of the singer is compared with the volume reference data in the MIDI message by a volume comparator. Based on the comparison results, the score data is obtained for evaluating the way by which the karaoke singer sings a song along with the accompaniment of the karaoke music.

The present invention has made it practical to detect the data for evaluating the way by which a karaoke singer sings a song, in correlation with the corresponding original song melody information. Consequently, based on the detected data, the karaoke scoring apparatus according to the present invention can correctly determine the singing skill of a karaoke singer.

The above and other objects, features and advantages of the present invention will become more apparent from the accompanying drawings, in which like reference numerals are used to identify the same or similar parts in several views.

DETAILED DESCRIPTION OF THE PREFERRED EMBODIMENTS

Figure 1:
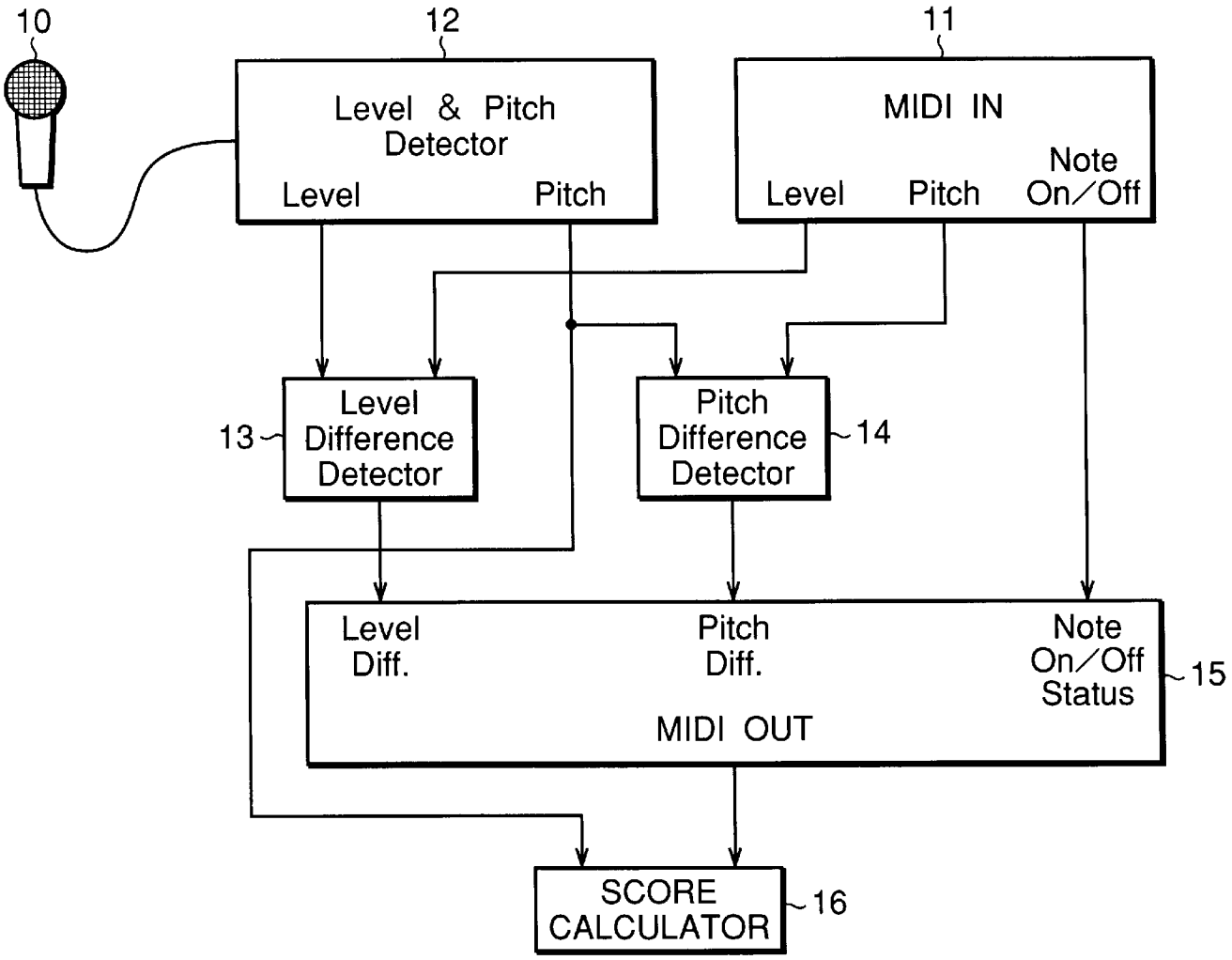
FIG. 1 is a general block diagram illustrating overall constitution of a karaoke scoring apparatus practiced as one preferred embodiment of the invention.

This invention will be described in further detail by way of example with reference to the accompanying drawings. Referring to FIG. 1, there is shown a general block diagram illustrating overall constitution of a karaoke scoring apparatus practiced as one preferred embodiment of the invention. In the preferred embodiment, a MIDI input unit (MIDI IN) 11 outputs volume reference data in the form of level data (Level) included in a MIDI message of a karaoke music data to a level difference detector 13. Also, the MIDI input unit 11 outputs pitch data (Pitch) included in the MIDI message to a pitch difference detector 14. Further, the MIDI input unit 11 outputs note-on/note-off status data (Note On/Off) included in the MIDI message to a note-on/off terminal (Note On/Off Status) of a MIDI output unit (MIDI OUT) 15.

A level and pitch detector 12 captures a voice signal converted by a microphone 10 from actual singing voice of a karaoke singer. The level and pitch detector 12 further operates based on the captured voice signal to extract therefrom volume sample data in the form of level data and to extract pitch sample data. The level and pitch detector 12 outputs the resultant level data (Level) to the level difference detector 13 and the resultant pitch data (Pitch) to the pitch difference detector 14.

The level difference detector 13 compares the level data from the MIDI input unit 11 with the level data from the level and pitch detector 12, and outputs resultant level difference data to a level difference terminal (Level Diff.) of the MIDI output unit (MIDI OUT) 15.

Figure 2:
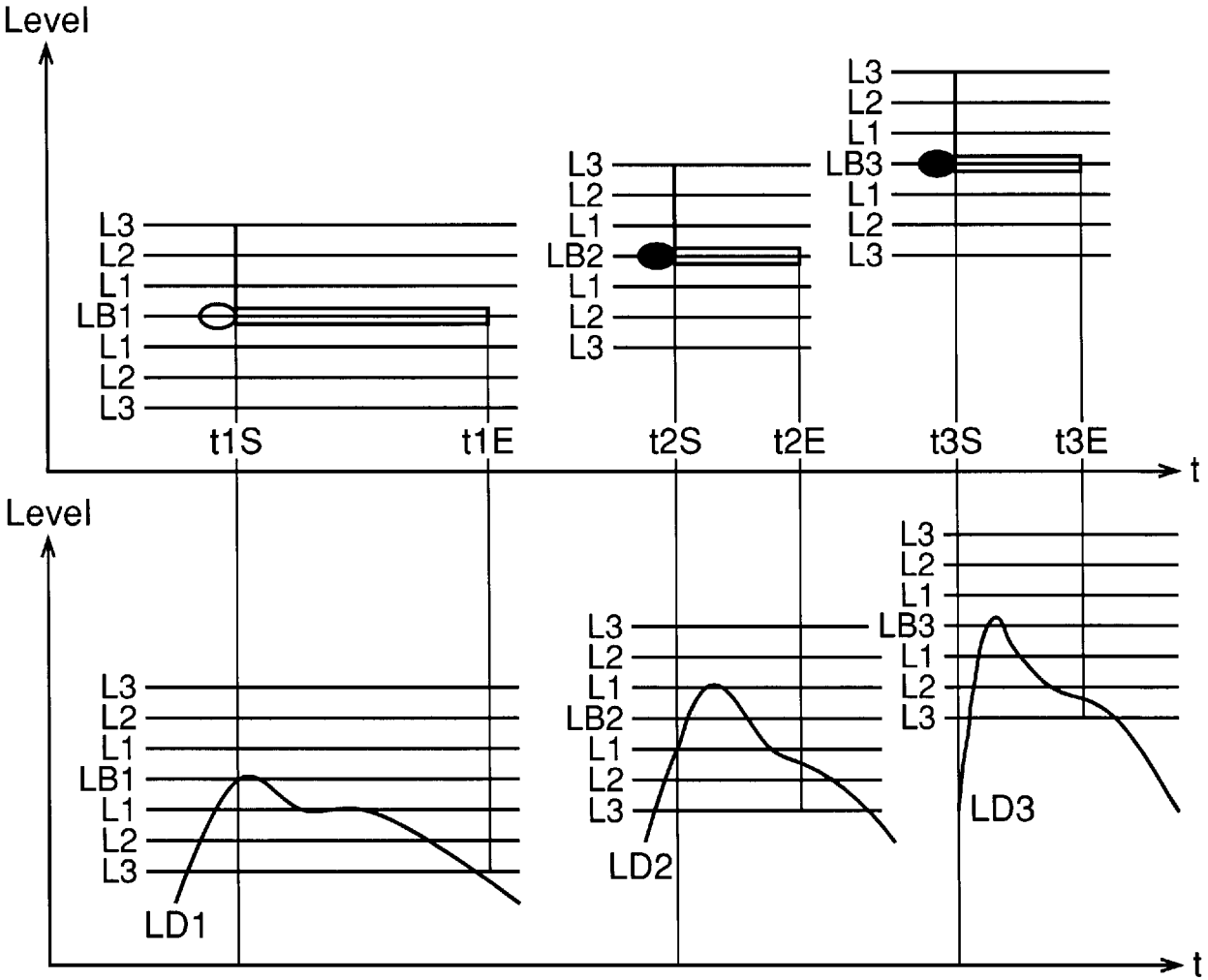
FIG. 2 is a diagram illustrating an example of volume reference data included in a MIDI message representing a reference singing sound, and an example of volume variation waveforms corresponding to a song actually sung by a karaoke singer.

Referring to FIG. 2, there is shown a diagram illustrating an example of level data included in a MIDI message representing a reference or model singing voice of the karaoke music, and an example of volume or level variation waveforms corresponding to an actual singing voice actually voiced by a karaoke singer. In the figure, an upper half portion indicates the level data outputted from the MIDI input unit 11 to the level difference detector 13 in the form of a note sequence corresponding to the MIDI message. The note sequence includes a half note of level data LB1, a quarter note of level data LB2, and another quarter note of level data LB3, which are arranged sequentially in this order. A lower half portion of the figure indicates level data LD1 through LD3 extracted from the singing voice actually sung by the karaoke singer. Namely, the lower half portion indicates one example of the level data LD1 through LD3 analyzed by the level and pitch detector 12.

The level difference detector 13 compares the level data LB1 through LB3 of the above-mentioned note sequence with the level data LD1 through LD3 corresponding to the song actually sung so as to determine a range of the level data LD1 through LD3 relative to the level data LB1 through LB3. For example, using the level data LB1 through LB3 as reference, the level difference detector 13 sets stepwise three levels L1 through L3 in upward and downward directions relative to each of the LB1 through LB3, and determines, at a predetermined period, to which range defined by these three levels the level data LD1 through LD3 belong. For example, if a tempo of the karaoke music is such that a quarter note is generated 125 times per minute, a sixteenth note is equivalent to 120 ms. If vocalization sustained time of one sixteenth note is about a half of the full note length, then the vocalization sustained time is 60 ms. Consequently, to obtain a sample value good enough for proper evaluation, it is required to place at least two detection points in this 60 ms. The level difference detector 13 therefore operates at every period of about 30 ms to determine which of the three ranges the level data LD1 through LD3 belong to. This period is defined according to a required resolution of the level or volume detection.

For example, if the level data LD1 is smaller than the level data LB1 at one of the detection points, the level difference detector 13 outputs "0" as a level difference sign to the level difference terminal of the MIDI output unit 15. If the level data LD1 is greater than the level data LB1, the level difference detector 13 outputs "1" to the level difference terminal of the MIDI output unit 15. Further, the level difference detector 13 outputs difference level data that indicates to which of three ranges of level L1 through L3 the level data LD1 belongs, to the level difference terminal of the MIDI output unit 15. The difference level data includes "00", "01", "10", and "11". The difference level data "00" denotes that the level data LD1 is in a range not exceeding the level L1. The difference level data "01" denotes that the level data LD1 is in a range between the level L1 and the level L2. The difference level data "10" denotes that the level data LD1 is in a range between the level L2 and the level L3. The difference level data "11" denotes that the level data LD1 is in a range exceeding the level L3.

The pitch difference detector 14 compares pitch data PB1 through PB3 outputted from the MIDI input unit 11 with pitch data PD1 through PD3 analyzed by the level and pitch detector 12, and outputs the resultant pitch difference data to a pitch difference terminal (Pitch Diff.) of the MIDI output unit (MIDI OUT) 15.

Figure 3:
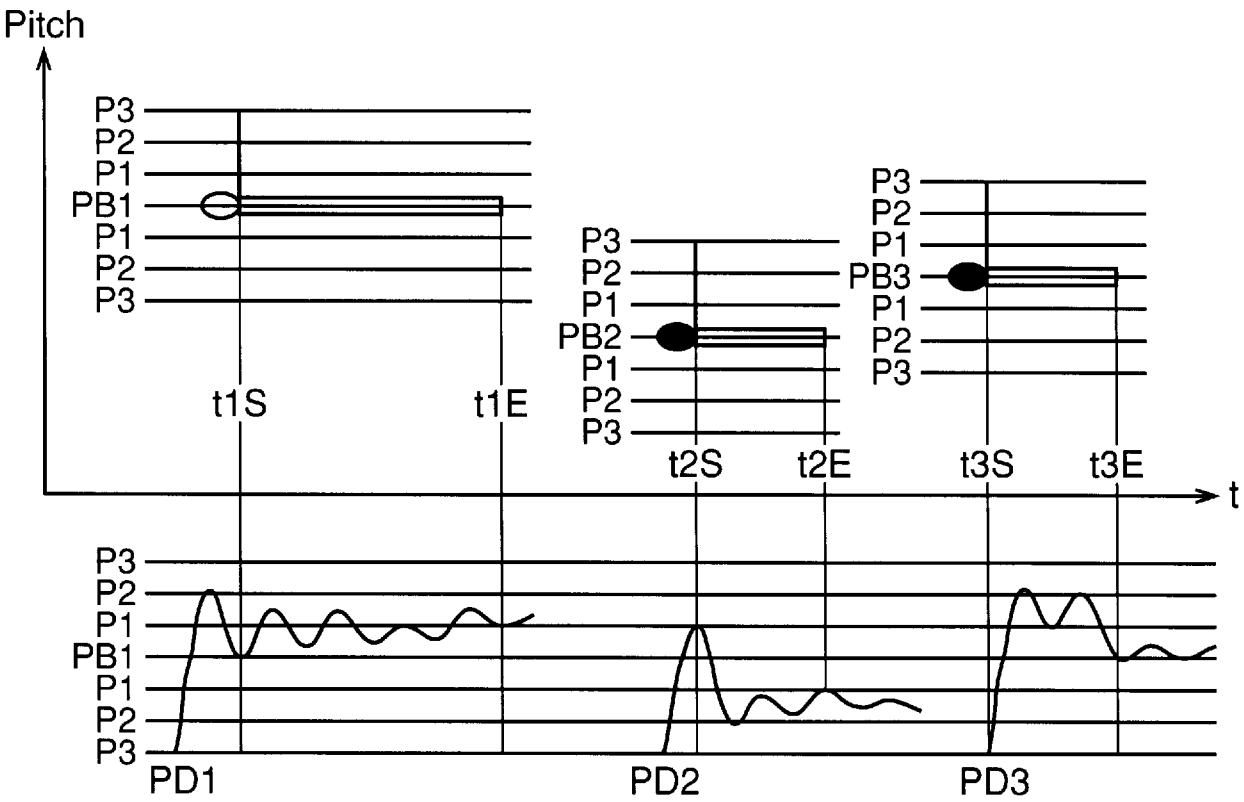
FIG. 3 is a diagram illustrating an example of pitch reference data included in a MIDI message representing a reference singing sound, and an example of pitch variation waveforms corresponding to a song actually sung by a karaoke singer.

Referring to FIG. 3, there is shown a diagram illustrating an example of reference pitches included in a MIDI message representing a reference singing sound, and an example of pitch variation waveforms extracted from a song actually sung by the karaoke singer. In the figure, the upper half portion indicates the pitch data outputted from the MIDI input unit 11 in the form of a note sequence extracted from the MIDI message. The note sequence induces a half note of pitch data PB1, a quarter note of pitch data PB2, and a quarter note of pitch data PB3 arranged successively in this order. The lower half portion of the figure indicates the pitch data PD1 through PD3 extracted from the song actually sung by the karaoke singer. Namely, the lower half portion of the figure indicates one example of the pitch data PD1 through PD3 analyzed by the level and pitch detector 12.

The pitch difference detector 14 compares the pitch data PB1 through PB3 corresponding to the prescribed notes of the melody data of the karaoke music and the pitch data PD1 through PD3 corresponding to phonemes of the actually sung voice with each other to determine to which range the pitch data PD1 through PD3 belong while using the pitch data PB1 through PB3 as reference. For example, using the pitch data PB1 through LB3 as reference, the pitch difference detector 14 sets three stepwise pitches P1 through P3 in upward and downward directions relative to each of the PB1 through PB3, and determines at every predetermined sampling period to which of the three pitch ranges the pitch data PD1 through PD3 belong. For example, if a tempo of the karaoke music is set such that a quarter note is generated 125 times per minute, a sixteenth note is equivalent to 120 ms. If the vocalization sustained time of this sixteenth note is about a half of the full note length, then the vocalization sustained time is 60 ms. Consequently, to obtain a sufficient evaluation sample value, it is required to place at least two detection points in the 60 ms time length. The pitch difference detector 14 therefore operates at a period of about 30 ms so as to determine which of the three pitch ranges the pitch data PD1 through PD3 belong to. This sampling period is defined according to the required resolution of the pitch sampling.

For example, if the pitch data PD1 is smaller than the pitch data PB1 at one of the detection points, the pitch difference detector 14 outputs "0" as a pitch difference sign to the pitch difference terminal of the MIDI output unit 15. If the pitch data PD1 is greater than the pitch data PB1, the pitch difference detector 14 outputs "1" to the pitch difference terminal of the MIDI output unit 15. Further, the pitch difference detector 14 outputs difference pitch data that indicates to which of the three pitch ranges P1 through P3 the pitch data LD1 belongs, to the pitch difference terminal of the MIDI output unit 15. The difference pitch data includes "00", "01", "10", and "11". The difference pitch data "00" denotes that the pitch data PD1 is in a range not exceeding the pitch P1. The difference pitch data "01" denotes that the pitch data PD1 is in a range between the pitch P1 and the pitch P2. The difference pitch data "10" denotes that the pitch data PD1 is in a range between the pitch P2 and the pitch P3. The difference pitch data "11" denotes that the pitch data PD1 is in a range exceeding either of the upper and lower pitches P3.

In the MIDI output unit 15, the note-on data of the first half note having the level data LB1 and pitch data PB1 is inputted at time t1S. Then, at time t1E, the note-off of the same note is inputted. At time t2S, the note-on data of the second quarter note having the level data LB2 and pitch data PB2 is inputted. Then, at time t2E, the note-off data of the same note is inputted. At time t3S, the note-on data of the third quarter note having the level data LB3 and the pitch data PB3 is inputted. Then, at time t3E, the note-off data of the same note is inputted.

Figure 4:
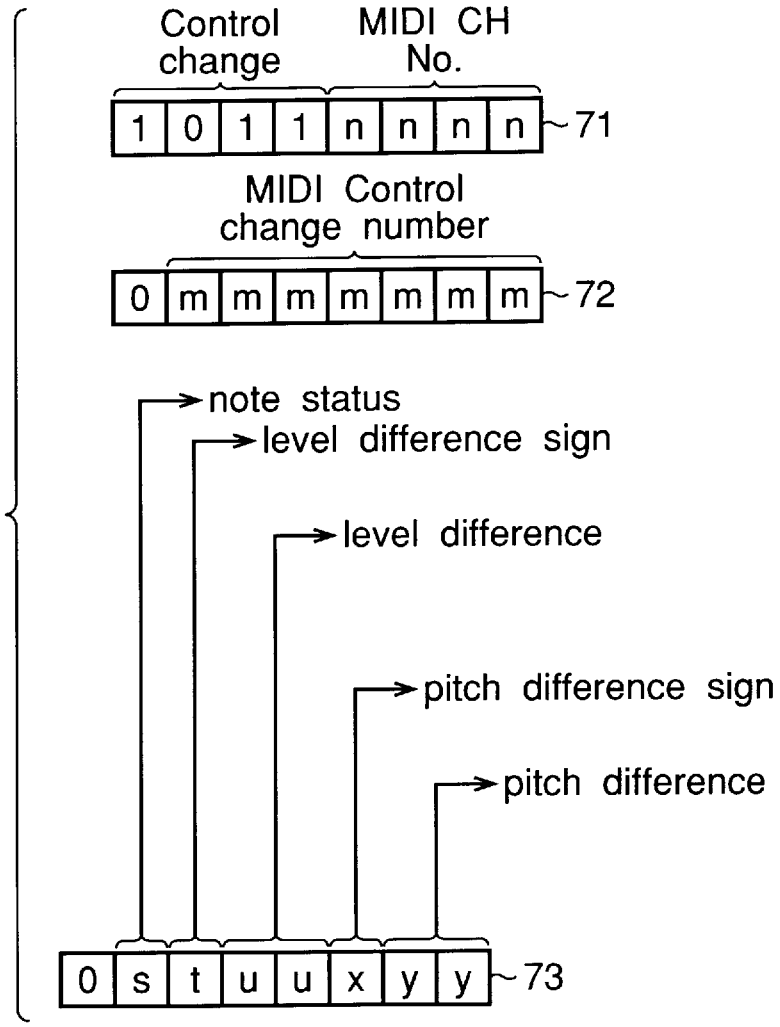
FIG. 4 is a diagram illustrating an example of a MIDI control message produced by a MIDI output device of the scoring apparatus.

Based on the various data inputted at the level difference terminal, the pitch difference terminal and the note-on/off terminal, the MIDI output unit (MIDI OUT) 15 generates a MIDI message as shown in FIG. 4, and outputs the generated message to a scoring calculator 16. Referring to FIG. 4, there is shown a diagram illustrating an example of the MIDI message generated by the MIDI output unit 15. In this example, the MIDI message is outputted as an extended control change message. As seen from FIG. 4, the control change message is composed of a status byte 71 of which most significant bit (identification bit) is "1", and two data bytes 72 and 73 of which most significant bits (identification bits) are "0"s. The status byte 71 is generally the same as the conventional MIDI status byte, the low-order four bits "nnnn" indicating a MIDI channel while the high-order four bits indicating a voice message type. In the present invention, the status byte shown in FIG. 4 is "BnH" indicating control change of a voice message.

Generally, this control change indicates a MIDI control change number by the first data byte 72. In the present embodiment, the low-order seven bits "mmmmmmm" of the data byte 72 indicate how the singing voice actually sung by the karaoke singer varies relative to a corresponding guide melody or a reference singing voice. To be more specific, in the present embodiment, a reserved control number not used in the music sound control is adopted for data transfer of the score data. For example, if "0mmmmmmm" of the data byte 72 is "01100110" in binary notation or "66H" in hexadecimal notation, the control change message indicates how the singing voice actually sung by the karaoke singer deviates relative to a first reference melody. If "0mmmmmmm" of the data byte 72 is "01100111" in binary notation or "67H" in hexadecimal notation, the control change message indicates how the singing voice actually sung by the karaoke singer deviates relative to a second reference melody. It should be noted that the first reference melody and the second reference melody apply to duet play, for example.

The data byte 73 indicates, in its lower seven bits "stuuxyy", variation degree of the level and pitch of the actually sung voice relative to the reference melody specified by the data type 72. Bit 7 "s" indicates a note status. When this bit is "0", it indicates note-off; when this bit is "1", it indicates note-on. For example, in the examples of FIGS. 2 and 3, bit 7 "s" turns to "1" from time t1S to time t1E, from time t2S to time t2E, and from time t3S to time t3E; otherwise, this bit stays at "0". Bit 6 "t" indicates a level difference sign. When this bit is "0", it indicates that the sample level data LD1 is smaller than the reference level data LB1; when this bit is "1", it indicates that the sample level data LD1 is greater than the reference level data LB1. Bit 5 and bit 4 "uu" are data indicating to which of three levels L1 through L3 the sample level data LD1 belongs. When these bits are "00", it indicates that the level data LD1 is in a range not exceeding either of the upper and lower levels L1. When these bits are "01", it indicates that the level data LD1 is in a range between the level L1 and the level L2. When these bits are "10", it indicates that the level data LD1 is in a range between the level L2 and the level L3. When these bits are "11", it indicates that the level data LD1 is in a range exceeding either of the upper and lower levels L3.

Bit 3 "x" indicates a pitch difference sign. When this bit is "0", it indicates that the sample pitch data PD1 is smaller than the reference pitch data PB1. When this bit is "1", it indicates that the sample pitch data PD1 is greater than the reference pitch data PB1. Bit 2 and bit 1 "yy" indicate to which of the three pitch ranges P1 through P3 the sample pitch data PD1 belongs. When these bits are "00", it indicates that the pitch data PD1 is in a range between the upper and lower pitches P1. When these bits are "01", it indicates that the pitch data PD1 is in a range between the pitch P1 and the pitch P2. When these bits are "10", it indicates that the pitch data PD1 is in a range between the pitch P2 and the pitch P3. When these bits are "11", it indicates that the pitch data PD1 is in a range exceeding either of the upper and lower pitches P3.

Figure 5:
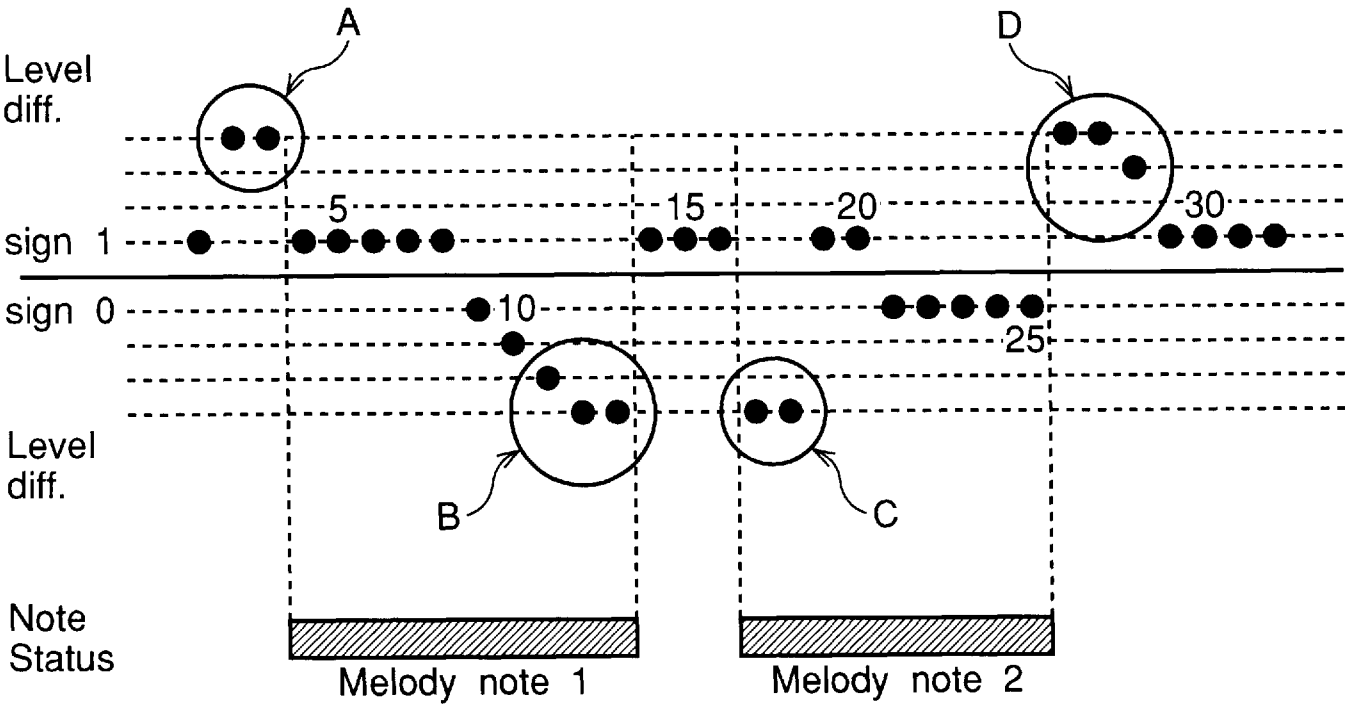
FIG. 5 is a diagram illustrating a control change message sequence outputted from the MIDI output device of to a scoring calculator.

Referring to FIG. 5, there is shown a diagram illustrating a sequence of control change message outputted from the MIDI output unit 15 shown in FIG. 1 to the scoring calculator 16. In the graph, the horizontal axis represents time while the vertical axis represents values of sample level data. It should be noted that the sample level data denotes a relative level position determined by the level difference sign indicated by bit 6 "t" of the data byte 73 shown in FIG. 4 and the quantized levels L1 through L3 indicated by bits 5 and 4 "uu" of the data byte 73. For example, the MIDI input unit 11 sequentially outputs a first melody note (Melody note 1), a second melody note (Melody note 2), and so on. At this moment, the MIDI output unit 15 obtains one control change message at a period of 30 ms, and outputs the obtained control change message.

Each control change message obtained from the example of FIG. 5 contains the third byte 73 represented by the values of bit 7 "s", bit 6 "t", and bits 5 and 4 "uu" as follows. The following shows the values of "stuu" of bit 7 through bit 4 of the data byte 73 arranged in time-sequential manner. It should be noted that "xyy" of bit 3 through bit 1 of the data byte 73 are handled in generally the same manner as "stuu".

| | | | |
|---|---|---|---|
| 1:"0100" | 2:"0111" | 3:"0111" | 4:"1100" |
| 5:"1100" | 6:"1100" | 7:"1100" | 8:"1100" |
| 9:"1000" | 10:"1001" | 11:"1010" | 12:"1011" |
| 13:"1011" | 14:"0100" | 15:"0100" | 16:"0100" |
| 17:"1011" | 18:"1011" | 19:"1100" | 20:"1100" |
| 21:"1000" | 22:"1000" | 23:"1000" | 24:"1000" |
| 25:"1000" | 26:"0111" | 27:"0111" | 28:"0110" |
| 29:"0100" | 30:"0100" | 31:"0100" | 32:"0100" |

Each piece of data included in this data string is denoted by a dot in FIG. 5. The number preceding each piece of data denotes the occurrence sequence of the corresponding dot. Referring to FIG. 5, portion A corresponding to the second and third control change messages is represented by 2:"0111" and 3:"0111". The portion A denotes a state in which the singer utteres a voice louder than the level L3 before the note-on of the first melody note. In other words, the singer starts vocalizing action 100 ms before the note-on of the first melody note. Portion B corresponding to the control change messages 11, 12, and 13 is represented by 11:"1010", 12:"1011", and 13:"1011". The portion B denotes that the singer stops vocalizing while the note-on time or the vocalization time of the first melody note is still continuing. In other words, the singer stops vocalization 100 ms earlier than the normal note-off time. Portion C corresponding to the control change messages 17 and 18 is represented by the sample data 17:"1011" and 18:"1011". The portion C denotes that the singer fails to vocalize after the note-on start time of the second melody note or during vocalization time. In other words, the singer stops vocalizing 100 ms before normal note-off time. Portion D corresponding to the control change messages 26, 27, and 28 is represented by the score data 26:"0111", 27:"0111", and 28:"0110". The portion D denotes that the singer still continues vocalizing although the second melody note is note-off or in the stopped state. In other words, the singer still continues vocalizing about 150 ms after the note-off. The scoring calculator 16 receives the above-mentioned series of control change messages to determine the above-mentioned singing states for the appropriate evaluation of the live vocal performance of the karaoke music.

The description of the above-mentioned preferred embodiment has been made with respect to the comparison of both pitch and level. It will be apparent to those skilled in the art that the comparison may be made only for the pitch or the level to output the comparison result as the control change messages. As described and according to the invention, the novel constitution provides an advantage of detecting score data for evaluating how the karaoke singer actually sings a song relative to the corresponding original song melody given by MIDI messages.

Referring back to FIG. 1, the inventive scoring apparatus is constructed for evaluating a live vocal performance which is voiced by a singer along with a karaoke music synthetically reproduced from melody data. The scoring apparatus is provided with a first detector in the form of the level and pitch detector 12 that sequentially detects the live vocal performance to extract therefrom sample data which is characteristic of actual voicing of the singer. A second detector in the form of the MIDI input unit 11 sequentially detects the melody data to extract therefrom time data representative of model progression of the karaoke music and reference data representative of model voicing which should match the karaoke music. A comparator in the form of the difference detectors 13 and 14 sequentially compares the sample data and the reference data with each other to produce differential data which indicates difference between the actual voicing and the model-voicing. A processor in the form of the MIDI output unit 15 processes the differential data with reference to the time data to produce score data which represents degree of deviation of the live vocal performance voiced by the singer relative to the karaoke music.

In detail, the first detector sequentially detects the live vocal performance to extract therefrom volume sample data which indicates volume variation of the actual voicing of the singer, and the second detector sequentially detects the melody data to extract therefrom volume reference data which represents volume variation of the model voicing which should match the karaoke music. Further, the first detector sequentially detects the live vocal performance to extract therefrom pitch sample data which indicates pitch variation of the actual voicing of the singer, and the second detector sequentially detects the melody data to extract therefrom pitch reference data which represents pitch variation of the model voicing which should match the karaoke music.

Practically, the second detector in the form of the MIDI input unit 11 sequentially detects the melody data containing a sequence of notes to extract therefrom note-on time data and note-off time data of each note to represent the model progression of the karaoke music, and the processor in the form of the MIDI output unit 15 processes the differential data with reference to the note-on time data and the note-off time data to produce the score data. Specifically, the second detector sequentially decodes the melody data provided in the form of MIDI message to extract therefrom the time data representative of the model progression of the karaoke music and the reference data representative of the model voicing which should match the karaoke music, and the processor processes the differential data with reference to the time data to produce the score data encoded into the form of MIDI message which represents degree of deviation of the live vocal performance voiced by the singer relative to the karaoke music. Further, the second detector sequentially detects the MIDI message to extract therefrom the time data in terms of sequential occurrence of notes representing the model progression of the karaoke music, and the reference data in terms of volume and pitch of the notes representing the model voicing which should match the karaoke music.

Figure 6:
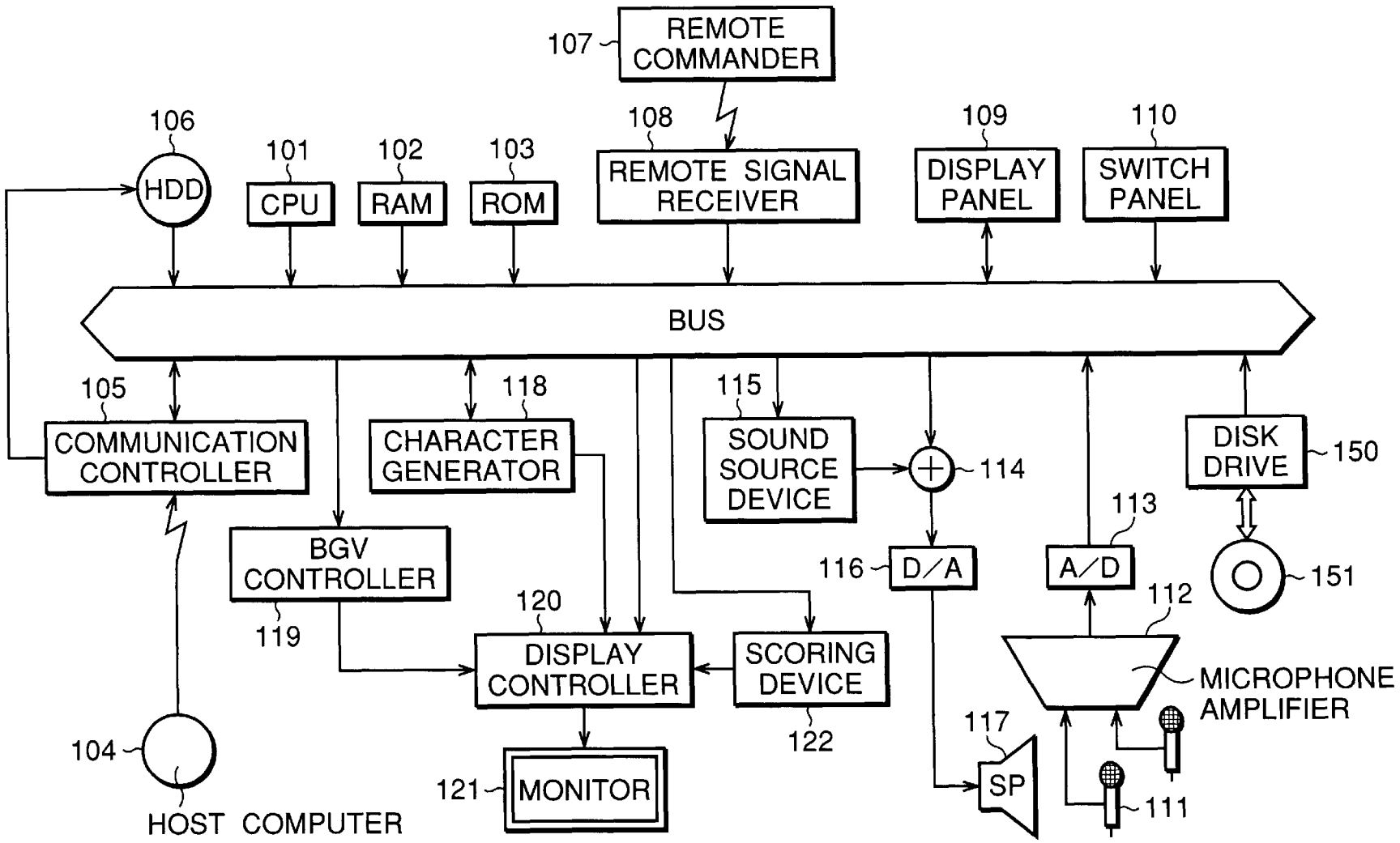
FIG. 6 is block diagram showing construction of a karaoke machine equipped with the inventive scoring apparatus.

Now, referring to FIG. 6, the block diagram illustrates a karaoke apparatus which utilizes the inventive scoring device. In the figure, reference numeral 101 indicates a CPU (Central Processing Unit) connected to other components of the karaoke apparatus via a bus to control these components. Reference numeral 102 indicates a RAM (Random Access Memory) serving as a work area for the CPU 101, and temporarily storing various data required. Reference numeral 103 indicates a ROM (Read Only Memory) for storing a program executed for controlling the karaoke apparatus in its entirety, and for storing information of various character fonts for displaying lyrics of a requested karaoke song. Reference numeral 104 indicates a host computer connected to the karaoke apparatus via a communication line. From the host computer 104, karaoke music data are distributed in units of a predetermined number of music pieces. The music data are composed of play data or accompaniment data for playing a karaoke musical sound, lyrics data for displaying the lyrics, wipe sequence data for indicating a sequential change in color tone of characters of the displayed lyrics, and image data indicating a background image or scene. The play data are composed of a plurality of data strings called tracks corresponding to various musical parts such as melody, bass, and rhythm. The format of the play data is based on so-called MIDI (Musical Instrument Digital Interface).

Referring to FIG. 6 again, reference numeral 105 indicates a communication controller composed of a modem and other necessary components to control data communication with the host computer 104. Reference numeral 106 indicates a hard disk (HDD) that is connected to the communication controller 105 and that stores the karaoke music data. Reference numeral 107 indicates a remote commander connected to the karaoke apparatus by means of infrared radiation or other means. When the user enters a music code and a key, for example, by using the remote commander 107, the same detects these inputs to generate a detection signal. Upon receiving the detection signal transmitted from the remote commander 107, a remote signal receiver 108 transfers the received detection signal to the CPU 101. Reference numeral 109 indicates a display panel disposed on the front side of the karaoke apparatus. The selected music code is indicated on the display panel 109. Reference numeral 110 indicates a switch panel disposed on the same side as the display panel 109. The switch panel 110 has generally the same input functions as those of the remote commander 107. Reference numeral 111 indicates a microphone through which a live singing voice is collected and converted into an electrical voice signal. Reference numeral 115 indicates a sound source device composed of a plurality of tone generators to generate music tone data based on the play data contained in the music data. One tone generator generates tone data corresponding to one tone or timbre based on the play data corresponding to one track.

The voice signal inputted from the microphone 111 is amplified by a microphone amplifier 112, and is converted by an A/D converter 113 into a digital signal, which is output as voice data. The voice data is fed to an adder or mixer 114. The adder 14 adds or mixes the music tone data and the voice data together. The resultant composite data are converted by a D/A converter 116 into an analog signal, which is then amplified by an amplifier (not shown). The amplified signal is fed to a speaker (SP) 117 to acoustically reproduce the karaoke music and the live singing voice.

Reference numeral 118 indicates a character generator. Under control of the CPU 101, the character generator 118 reads font information from the ROM 103 in accordance with lyrics word data read from the hard disk 106, and performs wipe control for sequentially changing colors of the displayed characters of the lyrics in synchronization with the progression of a karaoke music based on wipe sequence data. Reference numeral 119 indicates a BGV controller, which contains an image recording media such as a laser disk, for example. The BGV controller 119 reads image information corresponding to a requested music specified by the user for reproduction from the image recording media based on image designation data, and transfers the read image information to a display controller 120. The display controller 120 synthesizes the image information fed from the BGV controller 119 and the font information fed from the character generator 118 with each other to display the synthesized result on a monitor 121. A scoring device 122 scores or grades the singing performance according to the invention under the control of the CPU 101, the result of which is displayed on the monitor 121 through the display controller 120. The scoring device 122 is fed with the actual voice data picked up by the microphone 111 and the reference melody data contained in the karaoke music data.

A disk drive 150 receives a machine readable media 151 such as a Compact Disk or a Floppy Disk which contains programs loaded into the karaoke apparatus. The loaded programs are executed by the CPU 101 to control various devices including the scoring device 122. For example, the machine readable media 151 contains instructions for causing the scoring device 122 to perform operation of evaluating a live vocal performance which is voiced by a singer along with a karaoke music synthetically reproduced from melody data. The scoring operation comprises the steps of sequentially detecting the live vocal performance to extract therefrom sample data which is characteristic of actual voicing of the singer, sequentially detecting the melody data to extract therefrom time data representative of model progression of the karaoke music and reference data representative of model voicing which should match the karaoke music, sequentially comparing the sample data and the reference data with each other to produce differential data which indicates difference between the actual voicing and the model voicing, and processing the differential data with reference to the time data to produce score data which represents degree of deviation of the live vocal performance voiced by the singer relative to the karaoke music.

While the preferred embodiments of the present invention have been described using specific terms, such description is for illustrative purposes only, and it is to be understood that changes and variations may be made without departing from the spirit or scope of the appended claims.

What is claimed is:

1. A scoring apparatus for evaluating a live vocal performance which is voiced by a singer along with a karaoke music synthetically reproduced from melody data, the scoring apparatus comprising:

a first detector that sequentially detects the live vocal performance to extract therefrom sample data which is characteristic of actual voicing of the singer;

a second detector that sequentially detects the melody data to extract therefrom time data representative of model progression of the karaoke music and reference data representative of model voicing which should match the karaoke music;

a comparator that sequentially compares the sample data and the reference data with each other to produce differential data which indicates difference between the actual voicing and the model voicing; and a processor that processes the differential data with reference to the time data to produce score data which represents degree of deviation of the live vocal performance voiced by the singer relative to the karaoke music, wherein the score data includes a MIDI message containing note-on or note-off status.

2. A scoring apparatus according to claim 1, wherein the first detector sequentially detects the live vocal performance to extract therefrom volume sample data which indicates volume variation of the actual voicing of the singer, and the second detector sequentially detects the melody data to extract therefrom volume reference data which represents volume variation of the model voicing which should match the karaoke music.

3. A scoring apparatus according to claim 1, wherein the first detector sequentially detects the live vocal performance to extract therefrom pitch sample data which indicates pitch variation of the actual voicing of the singer, and the second detector sequentially detects the melody data to extract therefrom pitch reference data which represents pitch variation of the model voicing which should match the karaoke music.

4. A scoring apparatus according to claim 1, wherein the first detector sequentially detects the live vocal performance to extract therefrom volume sample data and pitch sample data, which respectively indicate volume variation and pitch variation of the actual voicing of the singer, and the second detector sequentially detects the melody data to extract therefrom volume reference data and pitch reference data, respectively representing volume variation and pitch variation of the model voicing which should match the karaoke music.

5. A scoring apparatus according to claim 1, wherein the second detector sequentially detects the melody data containing a sequence of notes to extract therefrom note-on time data and note-off time data of each note to represent the model progression of the karaoke music, and the processor processes the differential data with reference to the note-on time data and the note-off time data to produce the score data.

6. A scoring apparatus according to claim 1, wherein the second detector sequentially decodes the melody data provided in the form of MIDI message to extract therefrom the time data representative of the model progression of the karaoke music and the reference data representative of the model voicing which should match the karaoke music, and the processor processes the differential data with reference to the time data to produce the score data encoded in the form of MIDI message which represents degree of deviation of the live vocal performance voiced by the singer relative to the karaoke music, wherein the MIDI message contains a note-on or note-off status.

7. A scoring apparatus according to claim 6, wherein the second detector sequentially detects the MIDI message to extract therefrom the time data in terms of sequential occurrence of notes representing the model progression of the karaoke music, and the reference data in terms of volume and pitch of the notes representing the model voicing which should match the karaoke music.

8. A scoring apparatus for evaluating a live vocal performance which is voiced by a singer along with a karaoke music synthetically reproduced from melody data, the scoring apparatus comprising:

first detector means for detecting the live vocal performance to extract therefrom sample data which is characteristic of actual voicing of the singer;

second detector means for sequentially detecting the melody data to extract therefrom time data representative of model progression of the karaoke music and reference data representative of model voicing which should match the karaoke music;

comparator means for sequentially comparing the sample data and the reference data with each other to produce differential data which indicates difference between the actual voicing and the model voicing; and processor means for processing the differential data to produce score data which represents degree of deviation of the live vocal performance voiced by the singer relative to the karaoke music, wherein the score data includes a MIDI message containing note-on or note-off status processor means for processing the differential data to produce score data which represents degree of deviation of the live vocal performance voiced by the singer relative to the karaoke music, wherein the score data includes the MIDI message containing note-on or note-off status.

9. A scoring method of evaluating a live vocal performance which is voiced by a singer along with a karaoke music synthetically reproduced from melody data, the scoring method comprising the steps of:

sequentially detecting the live vocal performance to extract therefrom sample data which is characteristic of actual voicing of the singer;

sequentially detecting the melody data to extract therefrom time data representative of model progression of the karaoke music and reference data representative of model voicing which should match the karaoke music;

sequentially comparing the sample data and the reference data with each other to produce differential data which indicates difference between the actual voicing and the model voicing; and processing the differential data with reference to the time data to produce score data which represents degree of deviation of the live vocal performance voiced by the singer relative to the karaoke music, wherein the score data includes a MIDI message containing note-on or note-off status.

10. A machine readable media containing instructions for causing a scoring machine to perform a method of evaluating a live vocal performance which is voiced by a singer along with a karaoke music synthetically reproduced from melody data, wherein the method comprises the steps of:

sequentially detecting the live vocal performance to extract therefrom sample data which is characteristic of actual voicing of the singer;

sequentially detecting the melody data to extract therefrom time data representative of model progression of the karaoke music and reference data representative of model voicing which should match the karaoke music;

sequentially comparing the sample data and the reference data with each other to produce differential data which indicates difference between the actual voicing and the model voicing; and processing the differential data with reference to the time data to produce score data which represents degree of deviation of the live vocal performance voiced by the singer relative to the karaoke music, wherein the score data includes a MIDI message containing note-on or note-off status.

* * * * *